United States Patent [19]

Edamura et al.

[11] Patent Number: 4,543,137

[45] Date of Patent: Sep. 24, 1985

[54] WATER-IN-OIL EMULSION EXPLOSIVE COMPOSITION

[75] Inventors: Koji Edamura; Akio Torii; Kazuyuki Sato; Hiroshi Sakai, all of Aichi, Japan

[73] Assignee: Nippon Oil and Fats Co. Ltd., Japan

[21] Appl. No.: 656,892

[22] Filed: Oct. 2, 1984

[30] Foreign Application Priority Data

Oct. 21, 1983 [JP] Japan ..... 58-196180

[51] Int. Cl.[4] ..... C06B 45/02

[52] U.S. Cl. ..... 149/21; 149/2; 149/37; 149/38; 149/39; 149/40; 149/41; 149/42; 149/43; 149/44; 149/45; 149/46; 149/47; 149/55; 149/56; 149/57; 149/61; 149/62; 149/69; 149/70; 149/71; 149/72; 149/73; 149/76; 149/77; 149/78; 149/80; 149/82; 149/83; 149/85; 149/88; 149/92; 149/110; 149/105

[58] Field of Search ..... 149/2, 21, 37–47, 149/55–57, 61, 62, 69, 70–73, 76–78, 80, 82, 83, 85, 88, 92, 105, 110

[56] References Cited

U.S. PATENT DOCUMENTS

| | | | |
|---|---|---|---|
| 4,110,134 | 8/1978 | Wade | 149/2 |
| 4,111,727 | 9/1978 | Clay | 149/2 |
| 4,231,821 | 11/1980 | Sudweeks et al. | 149/2 |
| 4,287,010 | 9/1981 | Owen | 149/2 |
| 4,294,633 | 10/1981 | Clay | 149/2 |
| 4,308,081 | 12/1981 | Binet et al. | 149/2 |
| 4,343,663 | 10/1982 | Breza et al. | 149/2 |
| 4,371,408 | 2/1983 | Fillman | 149/2 |
| 4,474,628 | 10/1984 | Sudweeks et al. | 149/2 |
| 4,500,370 | 2/1985 | Hajto | 149/2 |

*Primary Examiner*—Stephen J. Lechert, Jr.
*Attorney, Agent, or Firm*—Parkhurst & Oliff

[57] ABSTRACT

A gas-retaining agent consisting of bubble assemblies, each bubble assembly being one particle consisting of a large number of bubbles agglomerated into the particle, is effective for improving the safety of water-in-oil emulsion explosive compositions against methane and coal dust, for improving the sympathetic detonability of the explosive compositions and for lowering their detonation velocity without deteriorating their strength.

12 Claims, No Drawings

WATER-IN-OIL EMULSION EXPLOSIVE COMPOSITION

BACKGROUND OF THE INVENTION (1) Field of the Invention

The present invention relates to a water-in-oil emulsion explosive composition, and more particularly relates to a cap-sensible water-in-oil emulsion explosive composition containing a gas-retaining agent consisting of bubble assemblies, each of which assemblies is one particle consisting of a large number of bubbles agglomerated into the particle, and having a very low detonation velocity, a very high safety against methane and coal dust and an excellent sympathetic detonation performance without lowering the strength.

(2) Description of the Prior Art

Various investigations have been recently made with respect to water-in-oil emulsion explosive (hereinafter, abbreviated as W/O explosive). For example, as disclosed in U.S. Pat. No. 3,161,551 and No. 3,447,978, the W/O exposive has an emulsified structure consisting of a continuous phase which consists of a carbonaceous fuel, and a disperse phase which consists of an aqueous solution of inorganic oxidizer salt, such as ammonium nitrate or the like, and is entirely different in the structure from hitherto been known oil-in-water slurry explosive (hereinafter, abbreviated as O/W explosive).

That is, O/W explosive has an oil-in-water structure, wherein an aqueous solution of inorganic oxidizer salt, a sensitizer and the like are dispersed in the form of a gel together with a gelatinizer as described, for example, in Makoto Kimura, "Slurry Explosive, Performance and Use Method", Sankaido (1975). On the contrary, W/O explosive has a water-in-oil microfine structure, wherein microfine droplets consisting of an aqueous solution of inorganic oxidizer salts and having a particle size of 10 μm–0.1 μm are covered with a very thin film of oil consisting of a carbonaceous fuel and a surfactant as described, for example, in Kogyo Kayaku Kyokai-Shi, 43 (No. 5), 285–294 (1982).

W/O emulsion is remarkably different from O/W emulsion in the performance and composition due to the above described difference in the structure. That is, O/W explosive requires to contain a sensitizer, such as aluminum (U.S. Pat. No. 3,121,036), monomethylamine nitrate (U.S. Pat. No. 3,431,155 and No. 3,471,346) or the like, and is relatively low in the detonation velocity. On the contrary, W/O explosive is good in the contact efficiency of the carbonaceous fuel with the inorganic oxidizer salt, and hence the W/O explosive has excellent properties. For examples, the W/O explosive is high in the detonation velocity, has cap-sensitivity in itself without containing sensitizer, is good in after-detonation fume, and can be changed widely in its consistency.

However, in order to maintain cap-sensitivity, propagation property of detonation, sympathetic detonation property and the like in a W/O explosive, that is, in order to ensure the detonation reliability of the explosive, it is necessary to adjust the specific gravity of the explosive by containing bubbles therein.

As the gas-retaining agent, hollow microspheres, each consisting of a single independent bubble, have hitherto been used. For example, U.S. Pat. No. 4,110,134 discloses the use of glass hollow microspheres or Saran resin hollow microspheres, both of which consist of single independent bubbles having a particle size of 10–175 μm; and a U.S. patent application filed July 5, 1984 discloses the use of resin hollow microspheres, each consisting of a single independent microsphere having a small particle size of not larger than 175 μm. All of these prior arts use hollow microspheres, each consisting of a single independent bubble having a small particle size. However, the W/O explosives containing these gas-retaining agents are high in the detonation velocity, and the production of W/O explosives having a high safety against methane or coal dust has been impossible. Moreover, hollow microspheres, each consisting of a single independent bubble, are very expensive, and it has been technically and ecconomically difficult to produce a W/O explosive having a low detonation velocity by using a large amount of the hollow microspheres.

The use of shirasu hollow microspheres obtained by firing volcanic ash and the like as a gas-retaining agent is disclosed in various prior arts (for example, Japanese Patent Laid-open Application No. 84,395/81). As the shirasu hollow microspheres, there are known shirasu hollow microspheres, each consisting of a single independent bubble, or shirasu hollow microspheres consisting of bubble assemblies, each bubble assembly being a secondary particle consisting of a relatively small number of bubbles fused to each other. However, these shirasu hollow microsphres are low in the effect for lowering the detonation velocity of a W/O explosive and were not able to attain a high safety against methane and coal dust in the resulting W/O explosive.

Alternatively, U.S. Pat. No. 4,008,108 discloses a method for producing a W/O explosive containing simple bubbles by adding a foaming agent or gas-generating agent to the raw material mixture during the production of the explosive or by blowing bubbles into the raw material mixture during the production thereof under mechanical stirring in place of the use of these gas-retaining agents. However, the simple bubbles as such can not be contained in the resulting W/O explosive in an amount more than a certain amount, are difficult to be contained in the W/O explosive for a long time, and leak from the explosive with the lapse of time, and hence the explosive loses its cap-sensitivity, deteriorates in a short time, and is not advantageous for practical use.

As described above, the production of a W/O explosive having a low detonation velocity is very difficult as compared with the production of an O/W explosive having a low detonation velocity. However, it is indispensable to produce an explosive having a low detonation velocity in order to produce an explosive having a safety against methane and coal dust.

A most general method for producing a W/O explosive having a low-detonation velocity is to produce a W/O explosive having a low specific gravity. In order to produce an explosive having a low specific gravity, it is necessary to contain a large amount of gas-retaining agent in the explosive. For example, even when a large amount of the above described hollow microspheres are used so as to contain 40% by volume, based on the volume of the resulting W/O explosive, of bubbles in the explosive, a W/O explosive having a detonation velocity of not higher than 3,000 m/sec can not be obtained. Moreover, the use of such large amount of expensive gas-retaining agent is not ecconomical, and results in a W/O explosive having a very low strength and a very poor detonation reliability, and the explosive can not be practically used. Further, there is known a method for lowering greatly a strength of an explosive in order to obtain a high safety against methane and coal dust in the explosive (for example, Japanese Patent Laid-open Application No. 155,091/81). For example, there is known a method, which uses a large amount of an inactive substance of flame coolant, such as sodium chloride, water or the like. However, in this method, a W/O explosive having a detonation velocity of not higher than 3,000 m/sec can not be obtained, and due to the presence of a large amount of such inactive substance, the resulting W/O explosive has a broken fine structure, deteriorates rapidly with the lapse of time and has no cap-sensitivity.

As an effective method for securing a high safety against methane and coal dust of a W/O explosive without deteriorating its strength, there is known a method which uses hollow microspheres having a relatively large particle size as a gas-retaining agent. However, hollow microspheres, each consisting of a single independent bubble, or bubble assemblies, each assembly being one particle consisting of less than 10 relatively small bubbles agglomerated into the particle, become lower noticeably in their strength corresponding to the increase of their particle size. For example, silica hollow microspheres having an average particle size of 600 $\mu$m are easily broken during the production of explosive, and damages the production installation for the explosive. Moreover, fragments of the silica hollow microspheres break the microfine structure of W/O explosive, and the resulting W/O explosive is deteriorated in its performance with the lapse of time. In addition, a W/O explosive containing such hollow microspheres is easily broken due to the pressure caused by the explosion in an adjacent bore hole at the blasting, and is apt to cause dead pressing. In order to obviate this drawback, it has been proposed to use strong hollow microspheres having a large wall thickness and a relatively large particle size. However, such glass hollow microspheres are difficult in obtaining them in the market, are expensive, and further have a large specific gravity and must be contained in a large amount in a W/O explosive, and the resulting W/O explosive is poor in the initiation performance and has not a satisfactorily low detonation velocity.

As described above, a W/O explosive has a high detonation velocity due to its microfine structure, and it is difficult to produce having a low detonation velocity by containing in it conventional hollow microspheres, each microsphere consists of a single independent bubble, and it is impossible to produce a W/O explosive surely having a high safety against methane and coal dust.

When ordinary explosive is used in a place, wherein combustible gases, such as methane and the like, or combustible dusts, such as coal dust and the like, are present, there is a risk of gas explosion or dust explosion. Such operation site, for example, coal mine or like is in duty bound to use an explosive having a safety higher than a given safety standard. In order to produce an explosive having a high safety against methane, coal dust and the like, it is indispensable to decrease the strength of explosive and further to decrease the detonation velocity. Particularly, in a W/O explosive having a relatively high detonation velocity, in order to obtain the same safety as that of O/W explosive, the strength of the W/O explosive must be extremely lowered. However, such W/O explosive is poor in the detonation reliability sympathetic detonability and storage stability, and can not be practically used. Moreover, the use of an explosive having a low strength is poor in the mining effect and increases the number of blasting times, resulting in an increased danger.

The inventors have variously studied in order to produce a cap-sensitive W/O explosive having a very low detonation velocity, a high safety and an excellent sympathetic detonability without decreasing extremely its strength, and surprisingly found out that the use of a gas-retaining agent consisting of bubble assemblies, each bubble assembly being a secondary particle consisting of a large number of bubbles agglomerated into the particle, can produce a W/O explosive having a very low detonation velocity, and have reached the present invention.

SUMMARY OF THE INVENTION

The object of the present invention is to provide a cap-sensitive W/O explosive having an excellent sympathetic detonability, a low detonation velocity and further a very high safety against methane and coal dust.

The feature of the present invention is the provision of a water-in-oil emulsion explosive composition comprising a continuous phase consisting of a carbonaceous fuel; a disperse phase consisting of an aqueous solution of inorganic oxidizer salt; an emulsifier and a gas-retaining agent, the improvement comprising the explosive composition containing, as the gas-retaining agent, 0.05–40% by weight based on the total amount of explosive composition of bubble assemblies, each bubble assembly being one particle consisting of a large number of bubbles agglomerated into the particle.

DESCRIPTION OF THE PREFERRED EMBODIMENT

As the carbonaceous fuel, which forms a continuous phase in the water-in-oil emulsion explosive composition of the present invention, there can be used any of hydrocarbon series substances of fuel oil and/or wax, which have been used for forming a continuous phase in conventional W/O explosives. The fuel oil includes, hydrocarbons, for example, paraffinic hydrocarbon, olefinic hydrocarbon, naphthenic hydrocarbon, aromatic hydrocarbon, other saturated or unsaturated hydrocarbon, petroleum, purified mineral oil, lubricant, liquid paraffin and the like; and hydrocarbon derivatives, such as nitrohydrocarbon and the like. The wax includes unpurified microcrystalline wax, purified microcrystalline wax, paraffin wax and the like, which are derived from petroleum; mineral waxes, such as montan wax, ozokerite and the like; animal waxes, such as whale wax and the like; and insect waxes, such as beeswax and the like. These carbonaceous fuels are used alone or in admixture. The compounding amount of these carbonaceous fuels is generally 1–10% by weight (hereinafter, % means % by weight based on the total amount of the resulting explosive composition unless otherwise indicated).

As the inorganic oxidizer salt for an aqueous solution of inorganic oxidizer salt, which solution forms the disperse phase in the W/O explosive of the present invention, use is made of, for example, ammonium nitrate; nitrates of alkali metal or alkaline earth metal, such as sodium nitrate, calcium nitrate and the like; chlorates or perchlorates of ammonia, alkali metal or alkaline earth metal, such as sodium chlorate, ammonium perchlorate, sodium perchlorate and the like. These inorganic oxidizer salts are used alone or in admixture of at least two members. The compounding amount of the inorganic oxidizer salt is generally 5–90%, preferably 40–85%. The inorganic oxidizer salt is used in the form of an aqueous solution. In this case, the compounding amount of water is generally 3–30%, preferably 5–25%.

In general, ordinary W/O explosives inclusive of the W/O explosive of the present invention use an emulsifier in order to obtain an emulsified structure. Therefore, in the present invention, any of emulsifiers which have hitherto been used in the production of W/O explosive can be used in order to attain effectively the object of the present invention. As the emulsifier, use is made of, for example, fatty acid esters of sorbitan, such as sorbitan monolaurate, sorbitan monooleate, sorbitan monopalmitate, sorbitan monostearate, sorbitan sesquioleate, sorbitan dioleate, sorbitan trioleate and the like; mono- or di-glycerides of fatty acid, such as stearic acid monoglyceride and the like; fatty acid esters of polyoxyethylenesorbitan; oxazoline derivatives; imidazoline derivatives; phosphoric acid esters; alkali or alkaline earth metal salts of fatty acid; primary, secondary or tertiary amine; and the like. These emulsifiers are used alone or in admixture. The compounding amount of the emulsifier is 0.1–10%, preferably 1–5%.

The gas-retaining agent of the present invention, which consists of bubble assemblies, each bubble assembly being one particle consisting of a large number of bubbles agglomerated into the particle, includes the following bubble assemblies; that is, bubble assemblies consisting of secondary particles, each secondary particle being produced by fusing or adhering with paste and the like at least 10 single independed bubbles of inorganic hollow microspheres, carbonaceous hollow microspheres and resin hollow microspheres, which inorganic hollow microspheres are produced from commonly used glass, alumina, shale, shirasu, silica sand, volcanic ash, sodium silicate, borax, perlite, obsidian and the like, which carbonaceous hollow microspheres are produced from pitch, coal, carbon and the like, and which resin hollow microspheres are produced from phenolic resin, polyvinylidene chloride resin, epoxy resin, urea resin and the like; and bubble assemblies having a cellular or spongy structure formed of agglomerated bubbles, and having been obtained by mixing a resin or rubber with a foaming agent. The resin includes thermosetting resins, such as phenolic resin, urea resin, epoxy resin, polyurethane resin, unsaturated polyester resin and the like, thermoplastic resins, such as polystyrene resin, ABS resin, polyethylene resin, polypropylene resin, polyvinyl chloride resin, cellulose acetate resin, acrylic resin and the like, and their copolymer resins and modified resins. The rubber includes natural rubber, synthetic rubber and the like. The foaming agent includes various foaming agents of inorganic foaming agent, organic foaming agent, low temperature hydrocarbon foaming agent and the like. The inorganic foaming agent includes ammonium carbonate, ammonium hydrogencarbonate, sodium hydrogencarbonate, ammonium nitrite, sodium nitrite, sodium borohydride, and azides, such as calcium azide and the like. The organic foaming agent includes azo compounds, such as azoisobutyronitrle, azodicarbonamide and the like, hydrazine derivatives, such as diphenylsulfone-3,3'-disulfohydrazine, 4,4'-oxybis(benzenesulfohydrazide), trihydrazinotriazine and the like, semicarbazide derivatives, such as p-toluylenesulfonylsemicarbazide and the like, triazole derivatives, such as 5-morpholine-1,2,3,4-thiatriazole and the like, and N-nitroso compound derivatives, such as N,N'-dinitrosopentamethylenetetramine, N,N'-dimethyl-N,N'-dinitrosoterephthalamide and the like. The low boiling temperature hydrocarbon foaming agent includes pentane, hexane, heptane, isobutylene, butane and the like.

As the preferable gas-retaining agent consisting of bubble assemblies, each bubble assembly being one particle consisting of a large number of bubbles agglomerated into the particle, there can be advantageously used a gas-retaining agent consisting of chip-shaped, bunch-shaped or globular secondary particles having a particle size of 0.1–5 mm, preferably 0.5–3 mm, each secondary particle consisting of 10 to several tens of thousands small independent cells having a diameter of 1–1,000 μm, coated with a very thin film and agglomerated into the secondary particle. When the diameter of a cell is less than 1 μm, the resulting W/O explosive is poor in the sympathetic detonability, and when the diameter of a cell is more than 1,000 μm, the number of agglomerated cells constituting one secondary particle is small, and the resulting explosive has not a satisfactorily low detonation velocity. The number of agglomerated cells in one secondary particle should be determined depending upon the particle size of secondary particles. When the secondary particle has a size less than 0.1 mm, the resulting explosive has not a satisfactorily low detonation velocity; and when the secondary particle has a size more than 5 mm, the resulting explosive is poor in the cap-sensitivity.

Bubble assemblies consisting of inorganic hollow microspheres are generally brittle and are apt to be broken during the course of production steps of an explosive. On the contrary, bubble assemblies consisting of organic hollow microspheres or cellular or spongy bubble assemblies produced from an organic polymer and a foaming agent are soft, are few in the breakage during the course of production steps of an explosive, and are very effective for lowering the detonation velocity of the resulting explosive. Moreover, these organic bubble assemblies themselves have a specific gravity smaller than that of inorganic bubble assemblies and therefore the organic bubble assemblies can adjust the specific gravity of the resulting explosive by the use of a small amount, and the use of the organic bubble assemblies is advantageous. Among the gas-retaining agents consisting of these organic bubble assemblies, there can be advantageously used chips having a particle size of 0.1–5 mm of foams obtained by crushing or cutting foamed polystyrene, foamed polyurethane, foamed polyethylene, foamed polyvinyl chloride, foamed polypropylene, foamed polymethyl methacrylate and the like, in view of the easy obtaining in the market and the ecconimical production of an explosive. Further, there can be most advantageously used prefoamed particles having a size of 0.1–5 mm, which have been obtained by prefoaming foamable beads of the above described polymers into 5–100 times their original volume, due to the reason that the prefoamed particles are very effective for lowering the detonation velocity of the resulting explosive and further the resulting explosive has a high sympathetic detonability.

The above described gas-retaining agents can be used alone or in admixture of at least two members. Moreover, the gas-retaining agent can be used in admixture with commonly known various hollow microspheres consisting of single independent bubbles. In this case, it is necessary that the gas-retaining of the present invention occupies at least 30% by volume, preferably at least 50% by volume, of the total volume of gas-retaining agent. When the volume is less than 30% by volume, the gas-retaining agent of the present invention can not exhibit fully the effect for lowering the detonation velocity of the resulting explosive, and moreover it is difficult to produce an explosive having a high safety against methane and coal dust. The compounding amount of the gas-retaining agent of the present invention in an explosive must be varied depending upon the volume of bubbles which occupies in the gas-retaining agent, but is generally 0.05–40% by weight, preferably 0.10–15% by weight, more preferably 0.15–10% by weight, based on the total amount of the resulting explosive. When the compounding amount is less than 0.05% by weight, the resulting explosive is poor in cap-sensitivity, and when the amount is more than 40% by weight, the resulting explosive is very poor in strength.

In the present invention, the use of a sensitizer is not necessary, but the use of a sensitizer together with the gas-retaining agent of the present invention is very advantageous due to the reason that the compounding amount of the gas-retaining agent can be greatly decreased and the detonability of the resulting explosive can be improved. The sensitizers to be used in the present invention include all the commonly known sensitizers, for example, monomethylamine nitrate, hydrazine nitrate, ethylenediamine dinitrate, ethanolamine nitrate, glycinonitrile nitrate, guanidine nitrate, urea nitrate, trinitrotoluene, dinitrotoluene, aluminium powder and the like. These sensitizers can be used alone or in admixture of at least two members. The compounding amount of the sensitizer is 0–80% by weight, preferably 0.5–50% by weight, more preferably 1–40% by weight, based on the total amount of the resulting explosive. When the amount is more than 80% by weight, the production of an explosive is dangerous and further the resulting explosive is expensive. Among the above described sensitizers, monomethylamine nirate, hydrazine nitrate, ethylenediamine dinitrate and ethanolamine nitrate are preferably used, and hydrazine nitrate are particularly preferably used, because of their high effect for promoting the dissolving of inorganic oxidizer salt in water and their low sensitivity and high safety in the handling during the production of explosive.

Further, in the present invention, the use of at least one of all the commonly known flame coolants, such as halogenides of alkali metal and alkaline earth metal, for example, sodium chloride, potassium chloride, sodium iodide, magnesium chloride and the like, is an effective means for improving the safety of the resulting explosive against methane and coal dust. Among the above described flame coolants, sodium chloride is most advantageous in view of an inexpensive production of an explosive having a high performance. Particularly, the use of finely divided sodium chloride having a particle size smaller than the 30 mesh sieve opening improves the safety of the resulting explosive against methane and coal dust. The compounding amount of the flame coolant is 0–50% by weight, preferably 1–40% by weight particularly preferably 5–30% by weight, based on the total amount of the resulting explosive. When the compounding amount of the flame coolant exceeds 50% by weight, the resulting W/O explosive is very poor in strength, is poor in cap-sensitivity, in detonation reliability and in storage stability, and can not be practically used.

The W/O explosive composition of the present invention is produced, for example, in the following manner.

An inorganic oxidizer salt is dissolved in water at about 60°–100° C. occasionally together with a sensitizer to produce an aqueous solution of the inorganic oxidizer salt. A carbonaceous fuel is melted together with an emulsifier (generally at 70°–90° C.) to obtain a combustible material mixture.

Then, the above obtained aqueous solution of the inorganic oxidizer salt is mixed with the combustible material mixture at a temperature of 60°–90° C. under agitation at a rate of 600–6,000 rpm, to obtain a W/O emulsion.

Then, the W/O emulsion is mixed with a gas-retaining agent according to the present invention and, occasionally, a flame coolant in a vertical type kneader while agitating the mass in the kneader at a rate of about 30 rpm, to obtain a W/O explosive composition. In the above described procedure, the sensitizer or a part of the inorganic oxidizer salt is not dissolved in water, but may be directly added to the emulsion and kneaded together with the emulsion, whereby a W/O explosive composition may be produced.

The following examples are given for the purpose of illustration of this invention and are not intended as limitations thereof. In the examples, "parts" and mean parts by weight.

EXAMPLE 1

A W/O explosive having a compounding recipe shown in Table 1 was produced in the following manner.

To 10.7 parts of water were added 73.4 parts of ammonium nitrate and 4.3 parts of sodium nitrate, and the resulting mixture was heated to 90° C. to dissolve completely the inorganic oxidizer salts and to obtain an aqueous solution of the inorganic oxidizer salts. A mixture of 3.4 parts of crude paraffin as a carbonaceous fuel and 1.7 parts of sorbitan oleate as an emulsifier was melted at 90° C. to produce a combustible material mixture. To the combustible material mixture was gradually added 88.4 parts of the above described aqeuous solution of the inorganic oxidizer salts while agitating the resulting mixture at a rate of 650 rpm under heating at 90° C. After completion of the addition, the resulting mixture was further agitated at a rate of 1,800 rpm for 3 minutes to obtain 93.5 parts of a W/O emulsion. Separately, glass miroballoons (trademark: Glass Microballoon B-28, sold by Minnesota Mining Manufacturing Co.) were washed with a 0.1% aqueous solution of vinyl acetate and dried in air to obtain secondary particles, each secondary particle consisting of at least 10 of the microballoons adhered and blocked to each other and having a shape similar to a bunch of grapes. The resulting secondary particle had a size of 0.1–5 mm. In a mortar were kneaded 6.5 parts of the gas-retaining agent consisting of the bubble assemblies formed of the secondary particles obtained through the above described blocking treatment and 93.5 parts of the above obtained W/O emulsion to produce a W/O explosive composition. The resulting W/O explosive composition was weighed 100 g by 100 g, and each mass was packed in a cylindrical viscose paper tube having a diameter of 30 mm to obtain a W/O explosive cartridge, which was used in the following performance test and safety test.

The explosion performance of the explosive composition was evaluated by the detonation velocity test under unconfined state and by the gap test on sand. The strength of the explosive composition was evaluated by the ballistic mortar test (abbreviated as BM). The safety of the explosive composition was evaluated by the mortar tests for methane and coal dust, and by the angle shot mortar tests for methane and coal dust.

The detonation velocity test under unconfined state was carried out in the following manner. The above obtained W/O explosive cartridge, packed in a cylindrical viscose paper tube having a diameter of 30 mm, was closed at the end by a clip. A probe was inserted into the cartridge, and the cartridge was kept at 20° C. The cartridge was initiated by means of a No. 6 electric blasting cap under unconfined state on sand, and the detonation velocity was measured by means of a digital counter.

The gap test on sand was carried out in the following manner. The above obtained cartridges, each having a diameter of 30 mm and a weight of 100 g, were kept a temperature of 5° C. and used. A donor cartridge provided with a No. 6 electric blasting cap and an acceptor cartridge were arranged on a semi-circular groove formed on sand such that both the cartridges were aprat from each other by a given distance indicated by the number of multiplied times of the cartridge diameter, and the donor cartridge was initiated under confined state, and the maximum distance, under which the acceptor cartridge was able to be inductively detonated, was measured and indicated by the number of multiplied times of the cartridge diameter.

The ballistic mortar test indicates a relative strength of a sample explosive to the static strength, calculated as 100, of TNT, and was carried out according to JIS K 4810.

The safety against methane or coal dust was measured according to JIS K 4811, Test Method for Safeties of 400 g permissible explosive, 600 g permissible explosive, and Eq. S-I and Eq. S-II permissible explosives. That is, 400 g (4 cartridges, each being 100 g) or 600 g (6 cartridges, each being 100 g) of sample explosive was charged into a shot-hole of a mortar, and whether methane or coal dust was inflamed or not was tested by a direct initiation of 400 g or 600 g of the explosive, wherein a No. 6 blasting cap was fitted to a cartridge arranged nearest to the inlet of the shot-hole such that the blasting cap was directed from the inlet side of the shot-hole to the bottom of the hole; or by an indirect initiation of 400 g of the explosive, wherein a No. 6 blasting cap was fitted to a cartridge arranged in the bottom of the shot-hole such that the blasting cap was directed from the bottom of the hole towards the inlet side of the hole. The safety of the explosive was indicated by the number of inflammation times of methane or coal dust based on the number of test times.

The angle shot mortar tests for methane and coal dust are methods for testing explosives having a higher safety, and have been carried out according to the test methods for Eq S-I and Eq S-II permissible explosives. The test results are shown by the maximum amount of an explosive which does not detonate 5 times in succession.

The obtained results in the above described tests are shown in Table 1.

EXAMPLES 2 AND 3

W/O emulsion explosives were produced according to the compounding recipe shown in Table 1 and according to Example 1. That is, in Example 2, a foamed polystyrene board and a rigid polyurethane foam were cut into chips having a particle size of 0.1–5 mm by means of a wire brush, and the chips were used as a gas-retaining agent. In Example 3, glass microballoons and resin microballoons were subjected to a blocking treatment in the same manner as described in Example 1, and the resulting secondary particles of the glass and resin microballoons were used as a gas-retaining agent. The results of the tests are shown in Table 1.

EXAMPLES 4–8

Into a stainless steel adihomo-mixer of 20 l capacity (a special machine HV-SL) were charged an aqueous solution of inorganic oxidizer salt, a sensitizer, an emulsifier and a carbonaceous fuel according to the compounding recipe shown in Table 1, and the resulting mixture was stirred at 80° C. for 1 minute by means of a paddle arranged in the homo-mixer, then the rotation speed of the homo-mixer was raised to 4,000 rpm in 7 minutes, and thereafter the mixture was stirred at a rate of 4,000 rpm for 30 minutes to obtain a W/O emulsion. Separately, finely divided sodium chloride having a particle size smaller than the 30 mesh sieve opening and a given amount of a gas-retaining agent shown in Table 1 were charged into a vertical type kneader (30DMV-RR type kneader made by Shinagawa Seisakusho), and then the above obtained W/O emulsion was charged into the kneader. The resulting mixture was stirred at 80° C. for 20 seconds at a rate of 10–30 rpm, treated with hand, and further stirred for 20 seconds to obtain a W/O explosive composition. The resulting explosive composition was packed into a cylindrical paper tube by means of a Rollex cartridge machine (Niepmann Jmbh. & Co.) to produce a W/O explosive cartridge having a diameter of 30 mm and a weight of 100 g. The results of the tests are shown in Table 1.

EXAMPLES 9 AND 10

W/O explosives were produced according to the compounding recipe shown in Table 1 and according to Example 1. However, in Examples 9 and 10, the emulsification was effected at 70° C. and at a rotation speed of 1,000 rpm. The results of the tests are shown in Table 1.

COMPARATIVE EXAMPLES 1–5

W/O explosives of Comparative examples 1–5 were produced according to such a compounding recipe shown in Table 1 that Comparative examples 1 and 2 correspond to Examples 1 and 2, Comparative example 3 corresponds to Example 5, Comparative example 4 corresponds to Example 8 and Comparative example 5 corresponds to Example 9. In all of these Comparative examples, a gas-retaining agent, which had hitherto been used for W/O explosive and consisted of single independent bubbles or bubble assemblies, each bubble assembly consisting of less than 10 bubbles, was used. It can be seen from Table 1 that the resulting explosives of Comparative examples 1–5 have a high detonation velocity and are poor in the safety against methane and coal dust.

TABLE 1

| | | | Example | | | | | | | | | | Comparative example | | | | |
|---|---|---|---|---|---|---|---|---|---|---|---|---|---|---|---|---|---|
| | | | 1 | 2 | 3 | 4 | 5 | 6 | 7 | 8 | 9 | 10 | 1 | 2 | 3 | 4 | 5 |
| Compounding recipe (parts by weight) | Aqueous solution of inorganic oxidizer salt | Ammonium nitrate | 73.4 | 73.4 | 73.3 | 45.0 | 47.0 | 47.0 | 47.0 | 39.3 | | | 73.4 | 73.4 | 47.0 | 39.3 | |
| | | Sodium nitrate | 4.3 | 4.3 | | 7.3 | 10.9 | 10.9 | 10.9 | 9.4 | 4.0 | 4.0 | 4.3 | 4.3 | 10.9 | 9.4 | 4.0 |
| | | Calcium nitrate | | | | 5.6 | | | | | 3.7 | 3.7 | | | | | 3.7 |
| | | Sodium chlorate | | | 4.2 | | | | | | | | | | | | |
| | | Water | 10.7 | 10.7 | 12.0 | 8.7 | 8.7 | 8.7 | 8.7 | 6.9 | 3.0 | 6.0 | 10.7 | 10.7 | 8.7 | 6.9 | 3.0 |
| | Sensitizer | Monomethylamine nitrate | | | | 3.6 | | | 2.0 | 16.6 | | | | | | 16.6 | |
| | | Hydrazine nitrate | | | | 3.6 | 7.2 | 5.2 | 5.2 | | 75.0 | 75.0 | | | 7.2 | | 75.0 |
| | | Ethylenediamine dinitrate | | | | | | 2.0 | | | 5.0 | | | | | | 5.0 |
| | | Ethanolamine nitrate | | | | | | | | | | 5.0 | | | | | |
| | Emulsifier | Sorbitan monoleate | 1.7 | 1.0 | 1.5 | 0.8 | 1.5 | 1.5 | 1.5 | | 1.0 | 1.0 | 1.7 | 1.0 | 1.5 | | 1.0 |
| | | Sorbitan sesquioleate | | 0.7 | | 0.3 | | | | 1.0 | | | | 0.7 | | 1.0 | |
| | | Stearic acid monoglyceride | | | | 0.4 | | | | 0.6 | | | | | | 0.6 | |
| | Carbonaceous fuel | No. 2 gas oil | | 1.0 | | | | | | 0.3 | | | | 1.0 | | 0.3 | |
| | | Crude paraffin wax | 3.4 | 2.4 | 3.0 | 3.0 | 2.9 | 2.9 | 2.9 | 2.8 | 2.0 | 2.0 | 3.4 | 2.4 | 2.9 | 2.8 | 2.0 |
| | Flame coolant | Sodium chloride (powdery) | | | | 21.7 | 21.2 | 25.0 | 25.0 | 20.9 | | 70.0 | | | 21.2 | 20.9 | |
| | | Potassium chloride (powdery) | | | | | | | | | 6.2 | | | | | | |
| | Gas-retaining agent (A) | (1) GMB (B-28) | | | | | | | | | | | 6.5 | | | 1.9 | 6 |
| | | (2) RMB (Microperl F-30 foam) | | | | | | | | | | | | | 0.6 | 0.3 | 0.3 |
| | | (3) SB (NW) | | | | 3.5 | | | | | | | | 6.5 | | | |
| | Gas-retaining agent (B) | (4) GB (blocked B-28) | 6.5 | | 0.4 | | | | | 0.1 | | | | | | | |
| | | (5) RB (blocked Microperl) | | | 0.3 | | | | | | | | | | | | |
| | | (6) SB (blocked NW) | | | | 1.5 | | | | | | | | | | | |
| | | (7) Foamed polystyrene chips | | 0.8 | | | | 0.6 | 0.2 | | | | | | | | |
| | | (8) Foamed polyethylene chips | | | | | | | | 0.4 | | | | | | | |
| | | (9) Rigid polyurethane foam chips | | 0.5 | | | | | | | | | | | | | |
| | | (10) Prefoamed particles 1 of foamable polystyrene | | | | | | | | | 0.1 | | | | | | |
| | | (11) Prefoamed particles 2 of foamable polystyrene | | | | | 0.6 | | | | | | | | | | |
| | | (12) Prefoamed particles of foamable polypropylene | | | | | | | | | | 1.0 | | | | | |
| | | (13) Sponge chips | | | | | | | 0.8 | | | | | | | | |
| performance | Density (20° C.) (g/cc) | | 1.10 | 1.03 | 1.13 | 1.23 | 1.15 | 1.21 | 1.16 | 1.25 | 1.47 | 1.31 | 1.11 | 1.15 | 1.16 | 1.25 | 1.20 |
| | Detonation velocity under unconfined state (20° C.) (m/sec) | | 2870 | 2400 | 2860 | 2690 | 1720 | 1650 | 1700 | 2060 | 1910 | 1850 | 4520 | 4110 | 4680 | 3770 | 5070 |
| | Sympathetic detonability | | 4 | 4 | 3 | 3 | 3 | 2.5 | 0.5 | 3 | 5 | 2.5 | 2 | 2.5 | 1.5 | 0.5 | 4 |

TABLE 1-continued

| | | | Example | | | | | | | | | | Comparative example | | | | |
|---|---|---|---|---|---|---|---|---|---|---|---|---|---|---|---|---|---|
| | | | 1 | 2 | 3 | 4 | 5 | 6 | 7 | 8 | 9 | 10 | 1 | 2 | 3 | 4 | 5 |
| | on sand (5° C.) (times) | | | | | | | | | | | | | | | | |
| | BM (TNT = 100) | | 103 | 113 | 105 | 74 | 76 | 70 | 70 | 68 | 126 | 58 | 103 | 102 | 75 | 66 | 125 |
| Safety test | Mortar test (number of inflammation (times)/(number of test times | test Direct initiation 400 g | 0/5 | 0/5 | 0/5 | | | | | | 0/5 | | 1/3 | 1/5 | 0/5 | | 1/1 |
| | | Direct initiation: 600 g | 1/3 | 0/5 | 1/3 | | | | | | 1/1 | | | | 1/5 | 0/5 | |
| | | Indirect initiation: 400 g | | 1/3 | | 0/5 | | | | | | | | | | 1/3 | |
| | Angle shot mortar test for methane (0/5, amount of explosive (g)) | | | | | 100 | 200 | 250 | 250 | 150 | | 200 | | | | 50 | |
| | Angle shot motar test for coal dust (0/5, amount of explosive (g)) | | | | | 200 | 300 | 400 | 400 | 300 | | 400 | | | | 100 | |

Among the ingredients shown in Table 1, gas-retaining agents (A) are hollow microspheres, each consisting of a single independent bubble, and being commonly used in a W/O explosive; and gas-retaining agents (B) are gas-retaining agents of the present invention, which consist of bubble assemblies, each assembly being one secondary particle consisting of at least 10 bubbles agglomerated into the particle. The particulars of these gas-retaining agents are as follows.

(1) GMB (B-28): sold by Minnesota Mining Manufacturing Co., trademark: Glass Microballoon B-28

(2) RMB (Microperl F-30 foam): A product obtained by foaming resin microballoons (trademark: Microperl F-30, sold by Matsumoto Yushi Seiyaku Co.) in an aqueous solution of ammonium nitrate and drying the foam in air.

(3) SN (NW): Silica balloons sold by Kushiro Sekitan Kanryu Co., trademark: NW, Microscopical observation shows that SB(NW) contains a large amount of particles, each particle having been formed by fusing less than 10 independent bubbles.

(4) GB (blocked B-28): Secondary particles obtained by washing GMB(B-28) described in the above item (1) in a 0.1% aqueous solution of vinyl acetate, drying the washed GMB(B-28) in air such that at least 10 glass microballoons are blocked into one secondary particle having a shape like a bunch of grapes.

(5) RB (blocked Microperl): Secondary particles obtained by blocking RMB in the above item (2) in the same manner as described in the production of GB (blocked B-28) and having a particle size of 0.1–5 mm.

(6) SB (blocked NW): Secondary particles which have been obtained by blocking SB in the above item (3) in the same manner as described in the production of GB (blocked B-28) and have a particle size of 0.1–5 mm.

(7) Foamed polystyrene chips: Chips which have been obtained by cutting a foamed polystyrene board, sold by Hitachi Chemical Co., Ltd., by means of a wire brush and have a particle size of 0.1–5 mm and a specific gravity of 0.012.

(8) Foamed polyethylene chips: Chips which have been produced from a foamed polyethylene, sold by Asahi Dow Limited, in the same manner as described in the production of foamed polystyrene chips and have a particle size of 0.1–5 mm and a specific gravity of 0.024.

(9) Rigid polyurethane foam chips: Chips obtained by cutting a rigid polyurethane foam, sold by Asahi Olin Co., Ltd., by means of a wire brush. The chips have a particle size of 0.1–5 mm and a specific gravity of 0.025.

(10) Prefoamed particles 1 of foamable polystyrene: Prefoamed particles obtained by prefoaming foamable polystyrene beads $JQ300D_6$, sold by YUKA Badische Co., Ltd. with steam into 50 times their original volume. Each of the prefoamed particles consists of a large number of cells having a diameter of 10–300 μm and fused into the prefoamed particle, and has a particle size of 1–3 mm and a specific gravity of 0.013.

(11) Prefoamed particles 2 of foamable polystyrene: Prefoamed particles obtained by prefoaming foamable polystyrene beads $IBED_6$, sold by YUKA Badische Co., Ltd. with steam into 40 times their original volume. Each of the prefoamed particles consists of a large number of cells fused into the prefoamed particle, and has a particle size of 0.5–2 mm and a specific gravity of 0.026.

(12) Prefoamed particles of foamable polypropylene: Prefoamed particles obtained by prefoaming a foamable polypropylene, sold by Mitsubishi Petrochemical Company, Ltd., with steam into 50 times their original volume. The prefoamed particles have a density of 0.021.

(13) Sponge chips: Chips which have been obtained by cutting a commercially available domestic sponge and have a particle size of 0.1–5 mm.

What is claimed is:

1. In a water-in-oil emulsion explosive composition comprising a continuous phase consisting of a carbonaceous fuel component; a disperse phase consisting of an aqueous solution of inorganic oxidizer salt; an emulsifier and a gas-retaining agent, the improvement comprising the explosive composition containing, as the gas-retaining agent, 0.05–40% by weight based on the total amount of explosive composition of bubble assemblies, each bubble assembly being one particle consisting of a large number of bubbles agglomerated into the particle.

2. A water-in-oil emulsion explosive composition according to claim 1, wherein the gas-retaining agent consists of organic bubble assemblies, each bubble assembly being one particle consisting of a large number of bubbles agglomerated into the particle.

3. A water-in-oil emulsion explosive composition according to claim 2, wherein the gas-retaining agent consists of chip-shaped or globular organic bubble assemblies formed of at least one member selected from the group consisting of foamed polystyrene, foamed polyethylene, foamed polypropylene, foamed polyurethane, foamed polyvinyl chloride and foamed rubber.

4. A water-in-oil emulsion explosive composition according to claim 3, wherein the gas-retaining agent consists of prefoamed particles of foamable polystyrene or/and chips of foamed polystyrene.

5. A water-in-oil emulsion explosive composition according to claim 1, wherein the explosive composition further contains at least one sensitizer selected from the group consisting of monomethylamine nitrate, hydrazine nitrate, ethanolamine nitrate, ethylenediamine dinitrate, urea nitrate, trinitrotoluene and aluminum powder.

6. A water-in-oil emulsion explosive composition according to claim 5, wherein the sensitizer is at least one member selected from the group consisting of monomethylamine nitrate, hydrazine nitrate, ethanolamine nitrate and ethylenediamine dinitrate.

7. A water-in-oil emulsion explosive composition according to claim 6, wherein the sensitizer is hydrazine nitrate.

8. A water-in-oil emulsion explosive composition according to claim 1, wherein the explosive composition further contains, as a flame coolant, at least one of halogenides of alkali metal and alkaline earth metal.

9. A water-in-oil emulsion explosive composition according to claim 8, wherein the flame coolant is sodium chloride.

10. A water-in-oil emulsion explosive composition according to claim 9, wherein the flame coolant is finely divided sodium chloride having a particle size smaller than the 30 mesh sieve opening.

11. A water-in-oil emulsion explosive composition according to claim 1, comprising 1–10% by weight of a carbonaceous fuel, 0.1–10% by weight of an emulsifier, 5–90% by weight of an inorganic oxidizer salt, 3–30% by weight of water, 0.05–40% by weight of a gas-retaining agent, 0–80% by weight of a sensitizer and 0–50% by weight of a flame coolant.

12. A water-in-oil emulsion explosive composition according to claim 11, comprising 1–10% by weight of a carbonaceous fuel, 0.1–10% by weight of an emulsifier, 5–90% by weight of an inorganic oxidizer salt, 3–30% by weight of water, 1–40% by weight of at least one sensitizer selected from the group consisting of monomethylamine nitrate, hydrazine nitrate, ethanolamine nitrate and ethylenediamine dinitrate, 1–40% by weight of sodium chloride as a flame coolant, and 0.1–15% by weight of a gas-retaining agent consisting of chips and/or globes having a particle size of 0.1–5 mm of organic bubble assemblies obtained from at least one member selected from the group consisting of foamed polystyrene, foamed polyethylene, foamed polypropylene, foamed polyurethane and foamed polyvinyl chloride.

* * * * *